United States Patent [19]

Palluel et al.

[11] 3,940,655

[45] Feb. 24, 1976

[54] MICROWAVE ELECTRONIC TUBE WITH AN IMPROVED COLLECTOR

[75] Inventors: Pierre Palluel; Jean Hervier; Jean Rousseau, all of Paris, France

[73] Assignee: Thomson-CSF, Paris, France

[22] Filed: June 13, 1974

[21] Appl. No.: 479,136

[30] Foreign Application Priority Data

June 19, 1973 France ..... 73.22306

[52] U.S. Cl. ..... 315/3.5; 315/5.38; 315/5.37

[51] Int. Cl.[2] ..... H01J 25/34

[58] Field of Search ..... 315/3.5, 3.6, 39.3, 5.38, 315/5.39

[56] References Cited

UNITED STATES PATENTS

| | | | |
|---|---|---|---|
| 2,853,641 | 9/1958 | Webber | 315/5.38 X |
| 2,984,762 | 5/1961 | Haas | 315/5.38 X |
| 3,363,137 | 1/1968 | Fiedor | 315/3.5 |

*Primary Examiner*—Saxfield Chatmon, Jr.
*Attorney, Agent, or Firm*—Roland Plottel

[57] ABSTRACT

In order to reduce the drawbacks, encountered in microwave electronic tubes, resulting from the presence of electrons reflected from the collector of these tubes towards the tube input, the invention provides for the collectors of these tubes to take the form of hollow bodies whose at least part of the internal volume exhibits an axis of symmetry not coinciding with the axis of the beam. This arrangement reduces the number of electrons liable to return towards the tube input and produces a spread in their phases. Application is made to klystrons.

5 Claims, 5 Drawing Figures

MICROWAVE ELECTRONIC TUBE WITH AN IMPROVED COLLECTOR

The present invention relates to microwave electronic tubes with a collector.

At the time of impact of the electron beam on the collector of a tube of this kind, electrons are returned to a greater or lesser extent towards the microwave structure in which they can, as a consequence of internal reaction, produce distortions in the high frequency signals applied to the tube input. The collector as described in accordance with the present invention, considerably reduces these effects.

The invention relates to all microwave tubes, for example klystrons and travelling wave tubes. In the present description, a detailed discussion of a multicavity klystron amplifier will be made.

In a klystron of this kind, an electron beam generated by an electron-gun is accelerated towards a succession of cavities, to the input of which succession of cavities the high frequency signal which is to be amplified is applied. The beam is guided along the axis of the succession of cavities (or interaction structure) by a magnetic field on the same axis. The beam is modulated by the high frequency of the first cavity and then, in the successive cavities, produces progressively stronger high frequency fields, which in turn increase the high frequency energy of the beam; this energy is extracted in the final cavity and taken to an external load circuit. In the ensuing text, these high frequency fields will also be characterised by voltages which, as those skilled in the art will appreciate, are defined as their integrals along the path of the beam. The beam is finally received by a collector which absorbs its residual energy. The high frequency structure and the collector are placed at a positive potential in relation to the emissive cathode of the electron-gun.

Electrons of the incident beam may, at the time of impact on the collector, either cause secondary electrons to be emitted from the bombarded metal, or be scattered back themselves by the impact surface with a still appreciable fraction of their incident energy. In this mechanism, the directions of re-emission, vary around a mean direction which depends upon the angle of the incident trajectory in relation to the impact surface. The electrons thus issuing from the collector, in turn undergo a fresh impact, certain of them producing fresh re-emission and so-on, until the initial energy is completely absorbed. However, a certain number of electrons may, after one or more re-emissions, be reflected back through the hole passing the incident beam, towards the interaction structure where the magnetic guidance field may facilitate their return to the input cavity. These returning electrons, "reflected" electrons as they are known, then pass through the high frequency fields created in the cavities by the direct beam, and there acquire a modulation which they carries towards the input cavity; this modulation is obviously the more marked the greater the number of reflected electrons; on the other hand, the incident beam on the collector may not have been perfectly demodulated in the final cavity so that there may be residual high frequency modulation in the reflected beam when it is reinjected into the high frequency structure, and this will promote internal reaction.

In the input cavity, the reflected modulated beam produces a high frequency reflection voltage $V_r$ which is added to the voltage $V_e$ to be amplified, furnished by the external source. These two voltages form the total voltage $V = V_e + V_r$ at the input of the structure and this, at the output, results in a voltage $V_s = A \cdot V$, $A$ being the voltage gain due to direct interaction. The ratio $A_r = V_r/V_s$ of the reaction voltage $V_r$ to the voltage $V_s$ of the output cavity, is a reverse gain. The overall amplification of the system is the ratio $G = V_s/V_e$) of the final voltage to the applied voltage; in accordance with the preceding relationships it is given by $$G = \frac{A}{1 - AA_r}.$$

The effect under consideration is thus characterised by the value of the reaction factor $(V_r/V) = AA_r$ the variations in which, in accordance with the nature of the re-emission of the reflected electrons and the reverse interaction, are responsible for distorting the amplitude and the phase of the signals being amplified. Since the amplifier generally must have a limited distortion factor, the permissible value of $A_r$ must be the smaller the more restricted said factor is and the higher the gain $A$ of the structure is to be; thus, if a higher gain klystron is to be designed, it is necessary to reduce the reverse gain still further. In accordance with what has been said earlier about the origin of this reaction, its reduction can primarily be achieved by reducing the number of reflected electrons and reducing the modulation which they possess at the time of their re-injection, this result requiring that the collectors be improved.

Various means have already been proposed in order to reduce the number of reflected electrons.

One of these means, for example, consists in covering the bombarded surface of the collector with a substance having a low re-emission power, such as carbon. However, the use of coatings has drawbacks associated with the very production of the deposit, with its uniformity, with its adhesion and with its retention of its properties over a long period of service.

Another means envisaged, is that of magnetic "trapping" of electrons using a magnetic field having an asymmetrical transverse component: this component deflects the incident beam towards a collector of suitable shape and opposes the return of reflected electrons to the interaction structure. This is not a very practical system to use by reason of the complexity of its construction and also because of the danger that within the final interaction zone there will be generated an asymmetrical magnetic field component capable of deflecting a fraction of the direct beam on to the walls of the structure with the possible consequence of excessive heating of this part and the re-emission of reflected electrons which escape trapping.

The object of the present invention is to reduce the reverse gain by reducing the number of electrons returned to the high frequency structure, and reducing their high frequency modulation with overcoming of the drawbacks of the aforementioned solutions.

In accordance with the invention, a collector is used which has, over all or part of its length, an axis of symmetry which differs from the common axis of the incident beam, the interaction structure and the magnetic guidance field. In accordance with one embodiment, the axis of symmetry of this part of the collector is an axis of revolution. In accordance with another embodiment, it is translated to give it an offset in relation to the beam axis. The collector can have an individual symmetry over the whole of its length but may equally well have portions of different symmetries at its ends, such as a base which obliquely truncates the central part of the collector or an initial portion concentric with the beam.

The main advantages of this embodiment are as follows: —in contrast to the usual case of a collector which is coaxial with the beam, the surface of impact of the incident beam is not symmetrical in relation to the beam axis and the trajectories of the re-emitted electrons no longer on average have the beam axis as their axis of symmetry; this asymmetry, with successive impacts, increases and finally the axis of the beam no longer constitutes a mean preferred direction of re-emission of electrons towards the interaction structure, unlike the case with a collector which is coaxial with the beam; hence, the re-emitted electrons are more effectively trapped at the internal wall of the collector. —on the other hand, the collector-beam asymmetry diversifies the trajectories and the transit times of the re-emitted electrons; the subsequent phase differences reduce the high frequency coherence between the electrons and therefore also the residual modulation in the reflected beam at the input to the interaction structure.

The desired advantages, i.e., reduction in the number of reflected electrons and their modulation, are thus achieved without it being necessary to employ additional electrical or magnetic expedients. A collector designed in accordance with the invention has made it possible, for example, to achieve a reduction in the order of 20 decibels in the reverse gain, by comparison with a collector having its axis coincidental with that of the beam.

In accordance with the invention, there is provided a microwave electronic tube comprising within an evacuated enclosure, arranged in alignement along an axis, an electron gun, an interaction space, and a hollow collector characterised in that it comprises means guiding the electrons of the beam, directed in operation from the cathode of said gun through said space towards said collector, to the entrance of said collector on trajectories parallel to said axis and characterised in that said collector exhibits an internal volume, part at least of which has a longitudinal axis of symmetry not coinciding with said axis.

The collector can furthermore comprise an anti-emissive deposit on part at least of its internal surface; the collector can also be made up of several mutually insulated portions separately connected through the sealed envelope of the tube to sources at different potentials. Similarly, it may be connected to the microwave structure by an insulating portion.

The invention will be better understood, from a consideration of the ensuing description and the attached figures.

Figure 1:
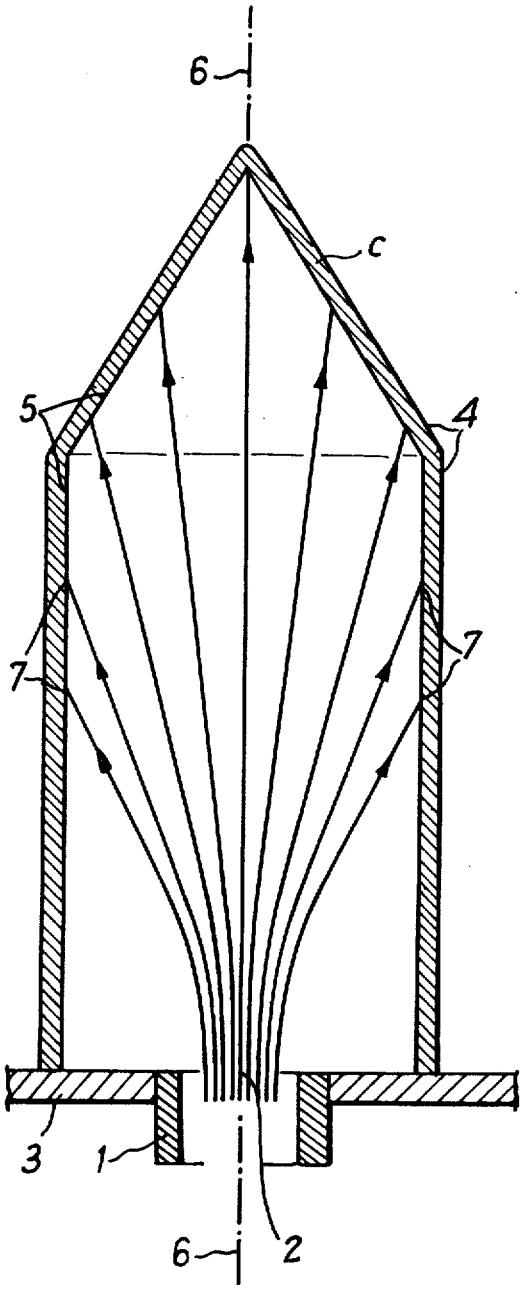
FIG. 1 illustrates an example of a prior art collector.
Figure 2:
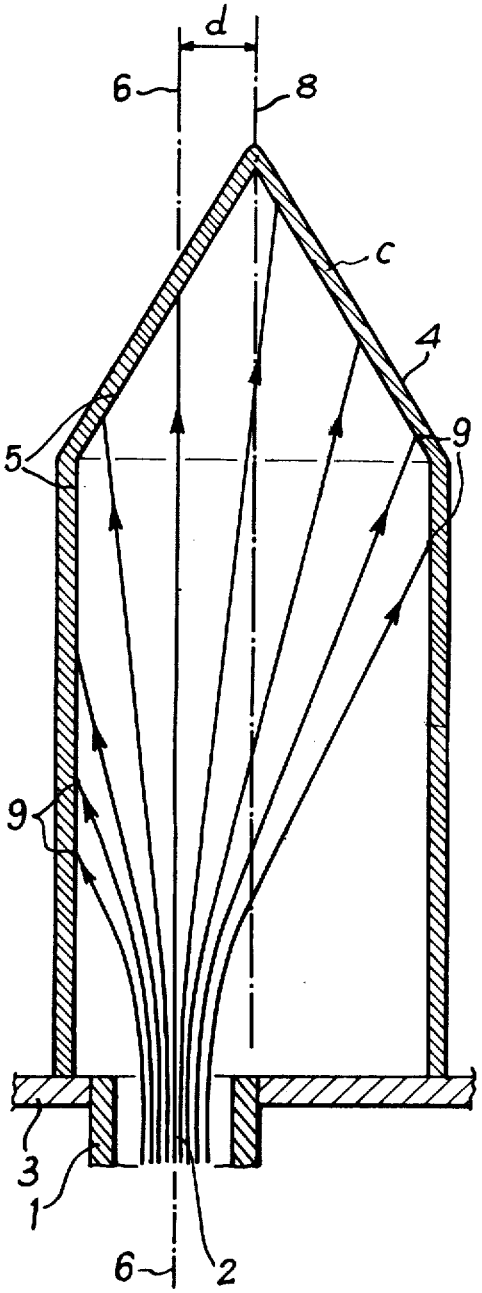
FIGS. 2, 3 and 4 illustrate embodiments of collectors of a microwave electronic tube in accordance with the invention.

In the sectional views of FIGS. 1 and 2, it is the terminal part 1 of the interaction structure, centered around the beam 2, as well as the polepiece 3, which terminate the magnetic beam guidance system. The external surface 4 of the collector C comprises some suitable device or other for dissipating the heat produced by the impact of the beam upon the internal surface 5. Beyond the polepiece, the magnetic guidance field weakens and the beam penetrating the collector flares into a solid of revolution, about the axis 6 of the incident beam as shown by the arrows.

The collector C of prior art shown in FIG. 1 is a solid of revolution about the axis 6 of the incident beam and the electrons in one and the same layer of the beam have symmetrical impacts 7 thereon; despite the dispersion of the successive impacts, their reflected electrons are re-emitted about the axis of the incident beam along trajectories which are relatively similar in terms of transit time and geometry.

The collector C of the microwave electronic tubes in accordance with the invention, shown in FIG. 2, by contrast exhibits an eccentricity *d* between its own axis of symmetry 8 and the axis 6 of the incident beam; the electrons in one and the same layer have asymmetrical impacts 9 on the collector and their re-emission is no longer preferentially along the axis of the beam; the trajectories of the re-emitted electrons are furthermore diversified in terms of their length. Thus, the removal of a preferred axis for the trajectories of the re-emitted electrons reduces the number and high frequency coherence of the electrons returning along the axis of the incident beam.

Figure 3:
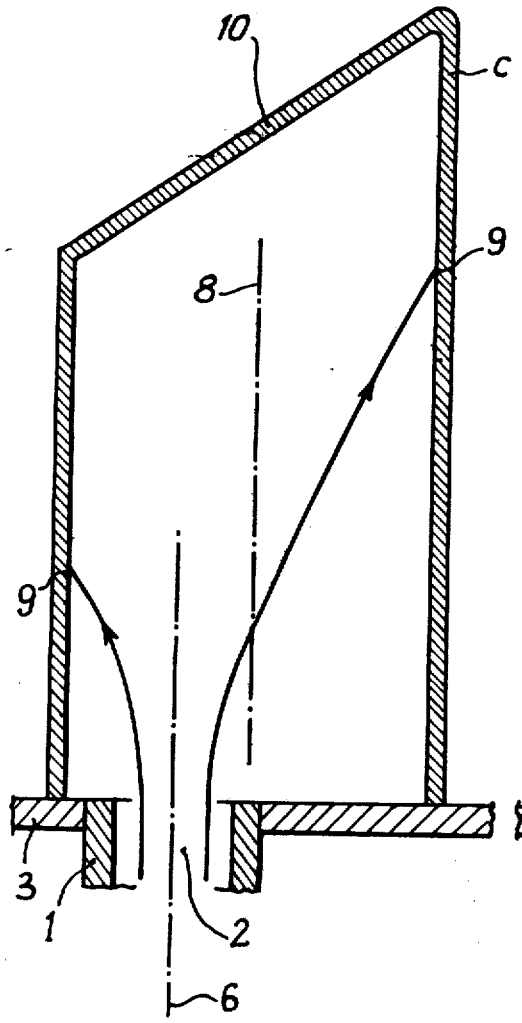
Figure 4:
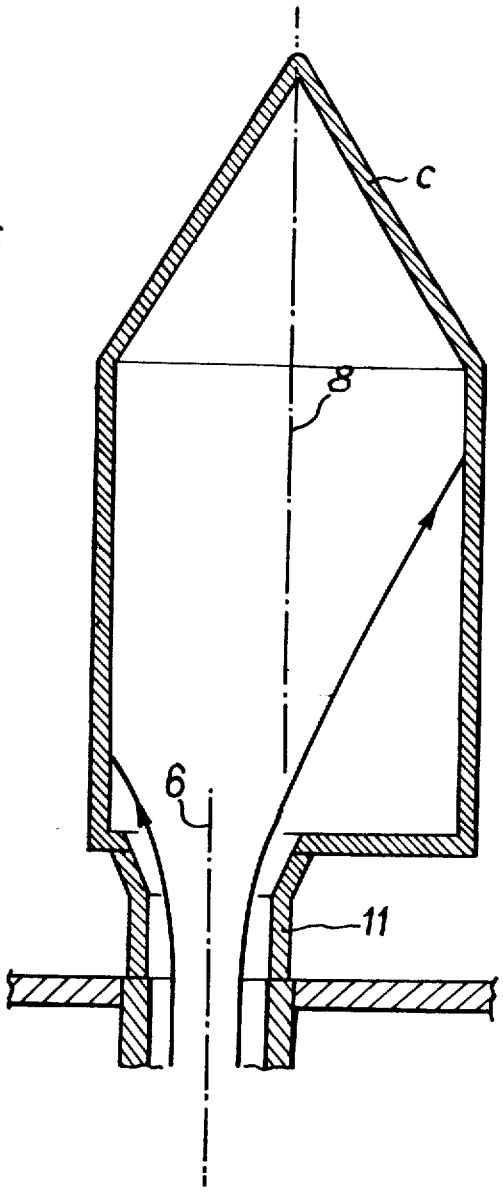

In a variant embodiment, the terminal part of the collector has a symmetry which differs from that of the central part. FIG. 3 illustrates a base 10 which obliquely truncates the eccentric portion of the collector whose axis of symmetry is 8. In accordance with another variant embodiment shown in FIG. 4, the initial part 11 of the collector, adjacent the interaction structure, has a symmetry of revolution about the axis of the incident beam.

Figure 5:
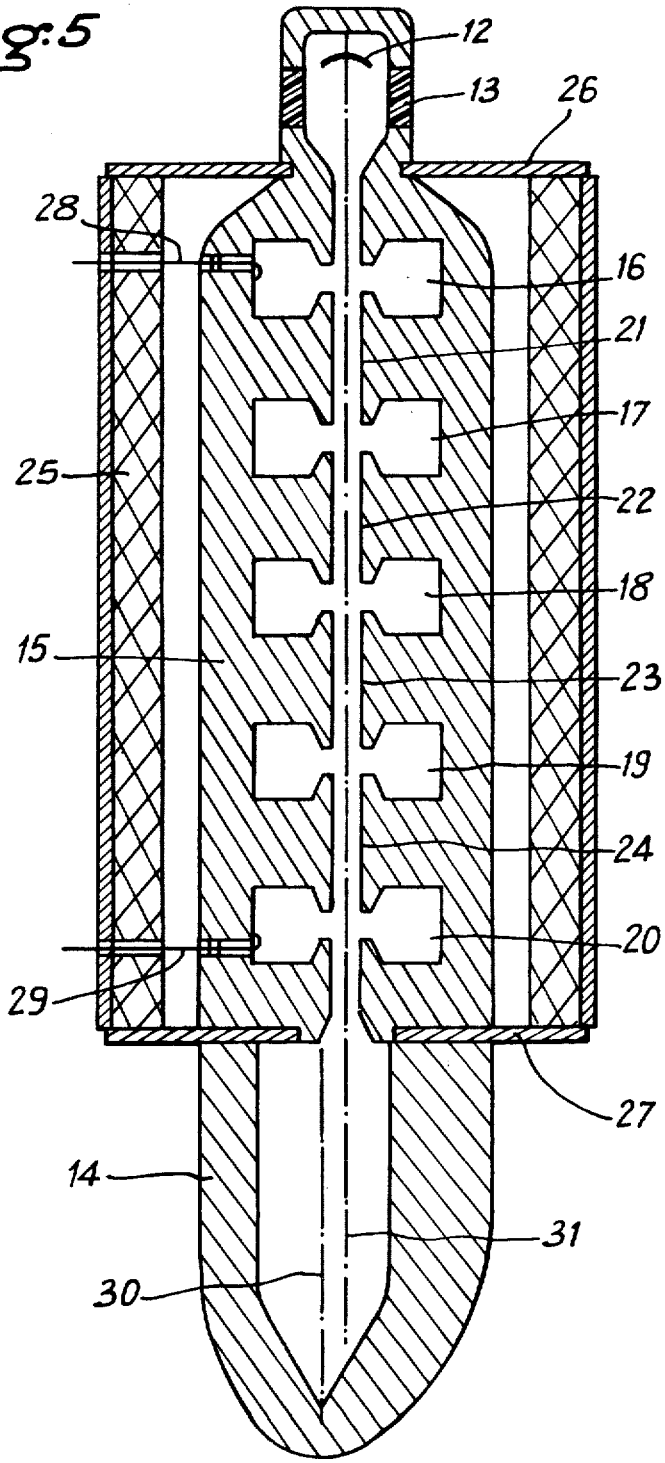
FIG. 5 is a schematic view, in section, of a klystron in accordance with the invention.

FIG. 5, in schematic section, illustrates a special adaptation of the invention to a klystron with five cavities. The klystron comprises an electron-gun end symbolically illustrated by the emissive cathode 12 and its insulating mounting 13, whilst at the other end there is a collector 14 and between these two parts of the system the interaction structure 15 with its five cavities. The cavities 16 to 20 are separated from one another by drift spaces 21 to 24 along the axis of which the beam is injected and guided by a magnetic field which has symmetry of revolution about the same axis and is produced for example by means of a coil focusing system 25; 26 and 27 are polepieces. The coupling loop 28 feeds the high frequency signal which is to be amplified and the coupling loop 29 extracts the high frequency signal amplified in the interaction structure, from the final cavity 20. The beam is finally received at the collector whose axis of symmetry 30 differs from that of the beam 31.

Of course, the invention is not limited to the embodiments described and shown which were given solely by way of example.

What is claimed is:

1. A microwave electronic tube comprising within an evacuated enclosure, arranged in alignment along an axis, an electron gun, an interaction space, a hollow collector for producing an electron beam propagating in operation from said gun through said space towards said collector, characterised in that said tube comprises means to produce a magnetic field on the path of said beam whose lines of force are parallel to said axis and means to stop said lines of force at the entrance of the beam into said collector so as to guide the electron beam through said entrance, whose axis is coincident with said axis, into said collector, in which it flares and impinges on a receiving area of the collector, and characterised in that at least the part of said collector on which said impingement takes place exhibits a portion having an axis of symmetry, said tube being further characterised in that said entrance axis is displaced in a transverse direction with respect to said axis of symmetry.

2. An electronic tube as claimed in claim 1, characterised in that that part of the collector disposed furthest from the interaction space is truncated obliquely in relation to the axis of symmetry.

3. An electron tube as claimed in claim 1, characterised in that that part of the collector, which is the closest to the interaction space, has an axis of revolution coinciding with the beam axis.

4. A microwave electronic tube as claimed in claim 1, characterised in that at least part of the internal surface of the collector is covered with a coating of an antiemissive material.

5. A microwave electron tube comprising within an evacuating enclosure arranged in alignment along an axis an electron gun, an interaction space, a hollow collector for producing an electron beam propagating in operation from said gun through said space toward said collector along said axis;

means for producing a magnetic field on the path of said beam whose lines of force are parallel to said axis;

means to stop said lines of force where said beam enters said collector, for guiding said electron beam into said collector where said beam flares and impinges on a receiving area of said collector;

at least a part of said collector on which said impingement takes place has a portion having an axis of symmetry which is displaced in a transverse direction from said beam axis.

* * * * *